US008938843B2

(12) United States Patent
Junkins

(10) Patent No.: US 8,938,843 B2
(45) Date of Patent: Jan. 27, 2015

(54) PAINT BRUSH CLEANING DEVICE

(75) Inventor: Richard Garland Junkins, Ardmore, AL (US)

(73) Assignee: Paint Piranha, Inc., Ardmore, AL (US)

( * ) Notice: Subject to any disclaimer, the term of this patent is extended or adjusted under 35 U.S.C. 154(b) by 999 days.

(21) Appl. No.: 12/840,086

(22) Filed: Jul. 20, 2010

(65) Prior Publication Data

US 2011/0017232 A1 Jan. 27, 2011

Related U.S. Application Data

(60) Provisional application No. 61/213,864, filed on Jul. 21, 2009, provisional application No. 61/335,241, filed on Jan. 4, 2010.

(51) Int. Cl.
*A47L 13/02* (2006.01)
*B08B 11/00* (2006.01)

(52) U.S. Cl.
CPC ..... *B08B 11/00* (2013.01)
USPC ..... 15/236.03; 15/236.06; 15/236.08; 15/236.09

(58) Field of Classification Search
CPC ..... A47L 13/08; A47L 13/022; A47L 13/02; B44D 3/16; B44D 3/164; B44D 3/162; B44D 3/006; B25G 3/14; B25G 3/18
USPC ..... 15/104.04, 236.01, 236.03, 15/236.05–236.09, 105, 118; 294/99.1–99.2; 30/169
See application file for complete search history.

(56) References Cited

U.S. PATENT DOCUMENTS

| | | | | | |
|---|---|---|---|---|---|
| 832,317 | A | * | 10/1906 | Hinds | 294/99.2 |
| 2,761,165 | A | | 9/1956 | Krzanowski | |
| 2,825,916 | A | | 3/1958 | Basala, Jr. | |
| 2,856,622 | A | | 10/1958 | Jacobsen | |
| 2,961,683 | A | | 11/1960 | Meyer | |
| 3,373,456 | A | | 3/1968 | Dalton | |
| 3,430,286 | A | | 3/1969 | Bownes | |
| 3,692,347 | A | * | 9/1972 | Bixler | 294/50.8 |
| 3,945,527 | A | | 3/1976 | Pylant | |
| 3,977,410 | A | * | 8/1976 | Huston et al. | 606/210 |
| 4,287,631 | A | | 9/1981 | Marrs | |
| 4,324,018 | A | * | 4/1982 | Olsson | 15/236.03 |

(Continued)

FOREIGN PATENT DOCUMENTS

| | | |
|---|---|---|
| CA | 2266697 | 9/1999 |
| GB | 2270464 | 3/1994 |
| WO | 98/49019 | 11/1998 |

OTHER PUBLICATIONS

Paint Brush Cleaner—Paint Roller Cleaner—Duluth Trading Company, found at http://www.duluthtrading.com/5200.aspx, printed on Jun. 21, 2010.

(Continued)

*Primary Examiner* — Laura C Guidotti
(74) *Attorney, Agent, or Firm* — Angela Holt; Bradley Arant Boult Cummings LLP

(57) ABSTRACT

A device for cleaning paint from a paintbrush is provided. Interlocking teeth are affixed to two cleaning heads rotatably connected together. The cleaning heads "sandwich" the bristles of the paintbrush and pull paint from the brush. Squeegee bars affixed to each of the cleaning heads clean paint from the outside of the brush while V-shaped teeth on tooth plates clean paint from within the bristles.

17 Claims, 5 Drawing Sheets

(56) References Cited

U.S. PATENT DOCUMENTS

| | | | |
|---|---|---|---|
| 4,912,797 | A | 4/1990 | Brackett |
| 5,185,938 | A | 2/1993 | Hutt |
| 5,272,782 | A | 12/1993 | Hutt |
| 5,406,967 | A | 4/1995 | Eberle |
| 5,546,625 | A | 8/1996 | Mealey, Sr. |
| 6,666,925 | B2 | 12/2003 | Brackett et al. |
| 6,779,535 | B2 | 8/2004 | Drukarov |
| 7,086,112 | B2 | 8/2006 | Smith et al. |
| 7,325,557 | B2 | 2/2008 | Wallace, III |
| 2005/0138750 | A1 | 6/2005 | Trincilla et al. |
| 2007/0221016 | A1 | 9/2007 | Herbst et al. |

OTHER PUBLICATIONS

International Search Report and Written Opinion issued in corresponding International Application No. PCT/US2010/042720 on Sep. 10, 2010.

* cited by examiner

PAINT BRUSH CLEANING DEVICE

CROSS-REFERENCE TO RELATED APPLICATIONS

This application claims priority to U.S. Provisional Application Ser. No. 61/213,864 filed on Jul. 21, 2009, and U.S. Provisional Application Ser. No. 61/335,241 filed on Jan. 4, 2010, both of which are incorporated herein by reference in their entirety.

FIELD OF THE INVENTION

The present invention relates generally to hand-held tools, and more particularly relates to a device for cleaning paint from paint brushes.

BACKGROUND AND SUMMARY OF THE INVENTION

Cleaning paint from paintbrushes has historically been a time consuming task, and failure to properly clean paintbrushes results in unnecessary waste in replacing brushes. A paint brush cleaning device according to the present disclosure separates the bristles of the brush and allows water and/or solvents to penetrate deep within the brush. The device further scrapes paint from the brush as it is being cleaned. Use of the device to clean paintbrushes reduces the amount of water and/or solvent that is required to clean brushes.

The device comprises a pair of cleaning heads rotatably connected to a handle. Each cleaning head comprises a plurality of V-shaped teeth. The user operates the handle to compress the bristles of the paintbrush between cleaning heads, causing the teeth to enter the bristles and pull paint from them. The device further comprises squeegee bars disposed outwardly from the teeth. The squeegee bars scrape paint from the outside of the brush while the teeth remove paint within the brush bristles.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

The disclosure can be better understood with reference to the following drawings. The elements of the drawings are not necessarily to scale, emphasis instead being placed upon clearly illustrating the principles of the disclosure. Furthermore, like reference numerals designate corresponding parts throughout the several views.

DETAILED DESCRIPTION

Figure 1:
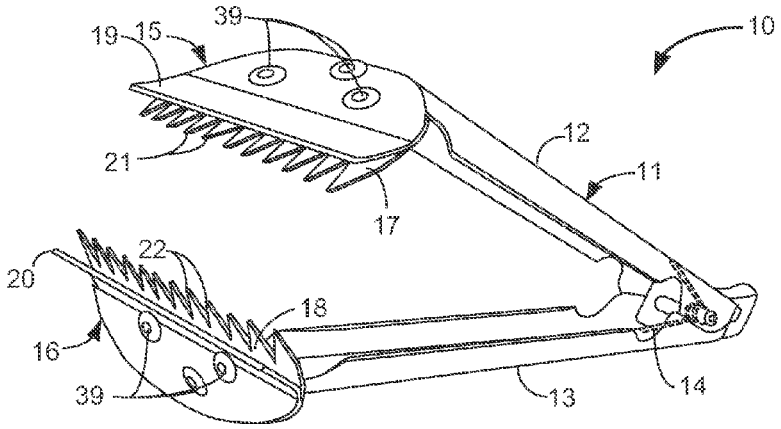
FIG. 1 is a front perspective view of an exemplary device in accordance with the present disclosure.

FIG. 1 is a side perspective view of a device 10 according to an exemplary embodiment of the present disclosure. The device 10 comprises a handle 11 comprising two arms 12 and 13 hingedly coupled together and biased with a spring 14. The handle 11 may be formed from any suitably rigid material, such as aluminum, stainless steel, plastic, or composite material.

The arms 12 and 13 each comprise a cleaning head 15 and 16, respectively. The arms 12 and 13 form a general "V" shape when the handle 11 is in a fully open position, i.e., when the cleaning heads 15 and 16 are furthest from each other.

Figure 3:
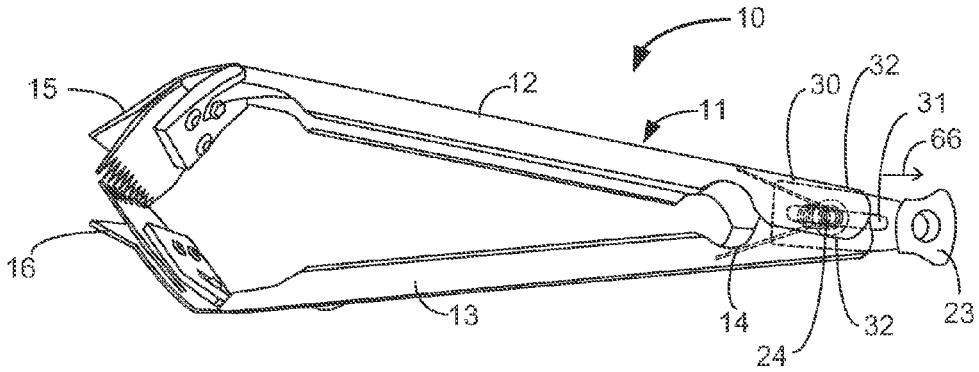
FIG. 3 is a side view of the device of FIG. 1, with the device in its closed position.

The spring 14 applies a spring force to urge the arms 12 and 13 apart unless acted upon by an outside force, such as a user's hand (not shown). In use of the device 10, the user's hand grasps the arms 12 and 13 and "closes" the handle 11 to cause the cleaning heads 15 and 16 to draw closer together, as further discussed herein and as illustrated in FIG. 3.

Figure 4:
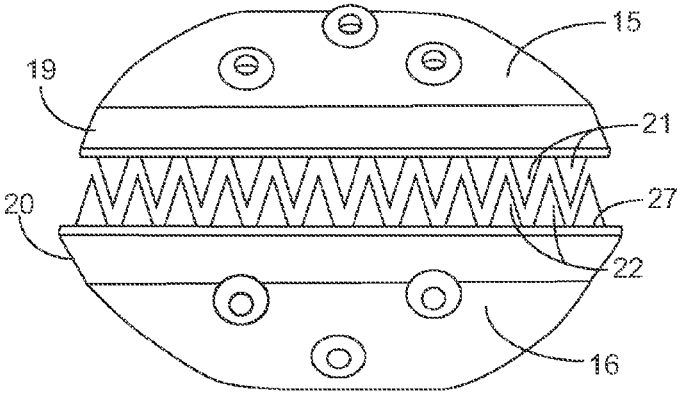
FIG. 4 is a front view of interlocking cleaning heads in accordance with the present disclosure.

Each cleaning head 15 and 16 comprises a tooth plate 17 and 18, respectively. The tooth plate 17 extends at an angle toward the tooth plate 18 in the illustrated embodiment. The tooth plates 17 and 18 each comprise a plurality of teeth 21 and 22 that protrude from the tooth plates 17 and 18, respectively. The plurality of teeth 21 and 22 each comprise a row of V-shape extensions from the tooth plates 17 and 18. In the illustrated embodiment, the teeth 21 and 22 are integrally formed with the tooth plates 17 and 18. The teeth 21 on the tooth plate 17 interlock with the teeth 22 on the tooth plate 18 when the cleaning heads 15 and 16 contact, as discussed below and as illustrated in FIG. 4.

The tooth plates 17 and 18 comprise generally thin pieces of rigid material, such as metal. The tooth plates 17 and 18 are rigidly affixed to the cleaning heads 15 and 16, respectively, via one or more fasteners 39. In some embodiments, the tooth plates 17 and 18 are removable and replaceable by the user (not shown) when worn or damaged, as discussed below and with respect to FIG. 9.

In the illustrated embodiment, the cleaning heads 15 and 16 each further comprise a squeegee bar 19 and 20, respectively. The squeegee bars 19 and 20 are disposed outwardly with respect to the plurality of teeth 21 and 22, as further discussed herein.

Figure 2A:
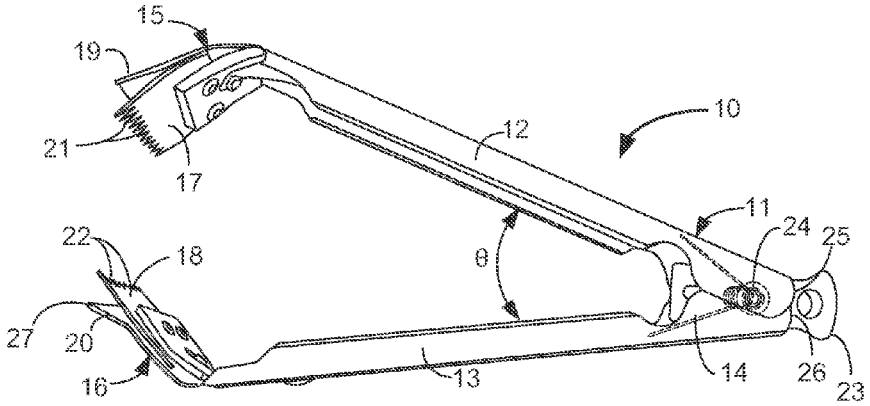
FIG. 2*a* is a side view of the device of FIG. 1.

FIG. 2*a* is a side view of the device 10 of FIG. 1. The arm 12 is rotatably connected to the arm 13 via a fastener 24, which is a rivet in one embodiment. The spring 14 is retained by the fastener 24. The arms 12 and 13 terminate at their free ends at the cleaning heads 15 and 16. The hinged ends 25 and 26 of the arms 12 and 13, respectively, are hingedly connected together by the fastener 24. A handle lock 23 extends from the ends 25 and 26 of the arms 12 and 13. Operation of the handle lock 23 is discussed further below and with respect to FIG. 3.

The arm 12 is disposed at an acute angle θ to the arm 13, and in one embodiment the acute angle θ is generally 45 degrees or less when the device 10 is in its fully open position. The acute angle θ is prevented from increasing beyond 45 degrees by the hinged ends 25 and 26 contacting the handle lock 23.

Figure 2B:
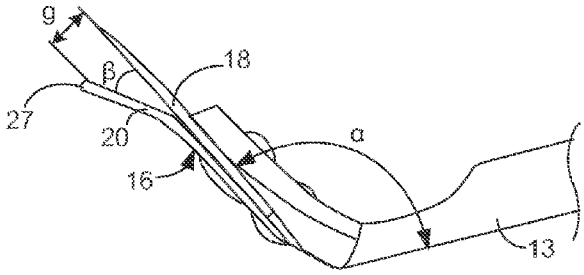
FIG. 2*b* is an enlarged side plan view of one of the cleaning heads of FIG. 2*a*.

FIG. 2*b* is an enlarged side plan view of the cleaning head 16 of FIG. 2*a*. The tooth plate 18 extends from the arm 13 at an angle α. In the illustrated embodiment, the angle α is an obtuse angle of about 135 degrees. In other embodiments, other angles may be employed.

The squeegee bar 20 extends from the cleaning head 16 and an angle β with respect to the tooth plate 18. The angle β sets a gap "g" between the tooth plate 18 and the outermost edge 27 of the squeegee bar 20. The gap g allows the squeegee bar 20 to remove paint (not shown) from the outside of a paintbrush (not shown) while the teeth 22 remove paint from within the paintbrush, as further discussed herein. Thus the gap g (and the angle β) would necessarily be smaller on devices 10 designed to clean paint (not shown) from smaller paintbrushes (not shown) and larger on devices 10 designed to clean paint from larger paintbrushes.

The preceding paragraph discusses the cleaning head 16 of the arm 13. The cleaning head 15 of the arm 12 is substantially similar to the cleaning head 16 of the arm 13 in one embodiment, except that the plurality of teeth 22 on the cleaning head 16 are positioned to interlock with the plurality of teeth 21 on the cleaning head 15, as further discussed herein and as illustrated in FIG. 4.

FIG. 3 is a side view of the device 10 when the device 10 is in its fully closed position, i.e., when the cleaning heads 15 and 16 contact. The handle lock 23 extends from the hinged ends 25 and 26 of the arms 12 and 13. When the handle is in its fully closed position (i.e., when the arms 12 and 13 are pulled together until the cleaning heads 15 and 16 contact), the handle 11 can be locked by pulling the handle lock 23 outwardly. In this regard, a lock plate 30 is rigidly affixed to the handle lock 23 and disposed within the handle 11. The lock plate comprises a slot 31 that is received by the fastener 24, which slideably retains the lock plate 30 within the handle 11. When the handle lock 23 is pulled outwardly (i.e., in the direction indicated by directional arrow 66), outer edges 32 of the lock plate 30 contact inner walls (not shown) of the arms 12 and 13 and prevent the arms 12 and 13 from opening further. To open the handle, the user simply pushes the handle lock 23 in the opposite direction.

FIG. 4 depicts the device 10 in its fully closed position with the cleaning heads 15 and 16 contacting each other. In this position, the plurality of teeth 21 of the cleaning head 15 may interlock with the plurality of teeth 22 of the cleaning head 16.

Figure 5:
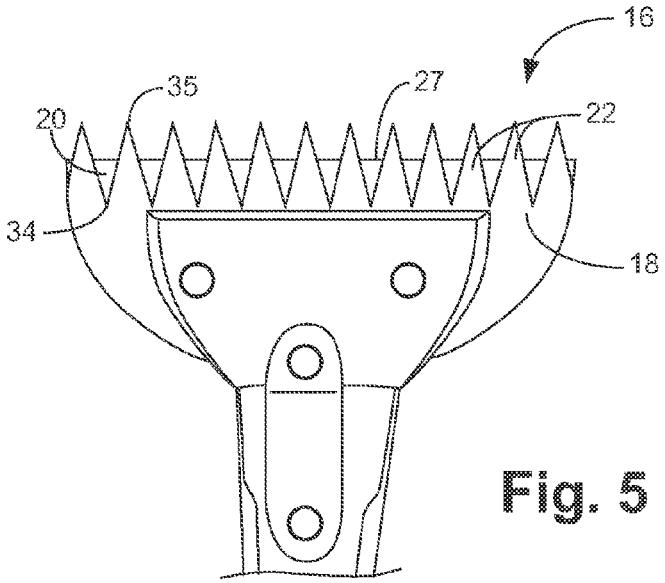
FIG. 5 is a rear plan view of a cleaning head of the device.

FIG. 5 is a rear plan view of the cleaning head 16 of FIG. 4 illustrating the relationship between the tooth plate 18 and the squeegee bar 20. In this embodiment, the outermost edge 27 of the squeegee bar 20 extends generally midway between the tips 35 of the teeth 22 and the lowermost points 34 of the teeth 22. Thus the outermost edge 27 of the squeegee bar 20 extends beyond the lowermost points 34 of the teeth 22 in this embodiment. The cleaning head 15 is substantially similar to the cleaning head 16, as discussed above. The squeegee bar 20 extends across the width of the tooth plate 18. The tooth plate 18 and squeegee bar 20 are generally wider than the paintbrush (not shown) being cleaned.

Figure 6:
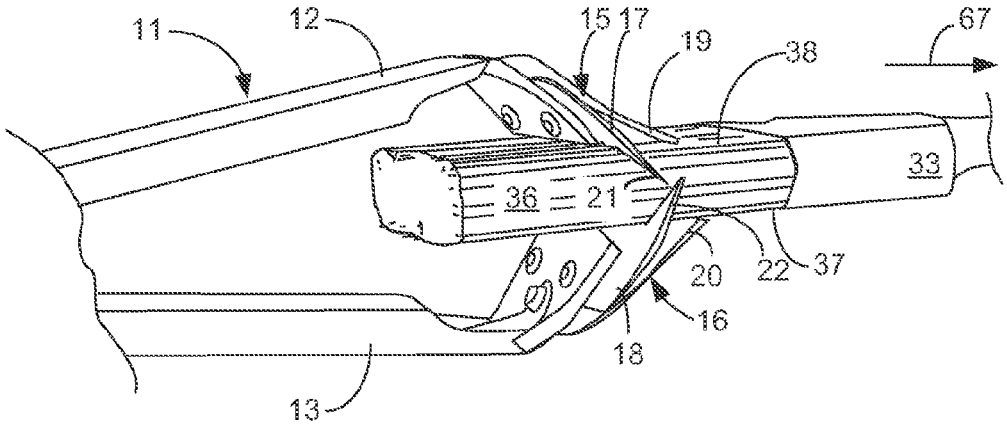
FIG. 6 is a side view of the device in use in cleaning a paintbrush.

FIG. 6 is a side view of the device 10 shown in the position of use in cleaning a paintbrush 33. When the device 10 is in use, the user (not shown) places the paintbrush 33 between the cleaning heads 15 and 16 and closes the handle 11. The user closes the handle 11 by pressing the arms 12 and 13 together. In this manner the tooth plates 17 and 18 "sandwich" the bristles 36 of the paintbrush 33 near the handle end 37 of the bristles 36. The plurality of teeth 21 and 22 extend into the bristles 36, separating the bristles 36 and stripping paint from them as the user pulls the brush 33 outwardly, i.e., in the direction indicated by directional arrow 67.

If the device 10 and paintbrush 33 are placed under running water (not shown), the teeth 21 and 22 separating the bristles 36 exposes the bristles 36 deep within the paintbrush 33 to water, which cleans the bristles. While the teeth 21 and 22 are extending into the bristles 36 to clean deep within the paintbrush 33, the squeegee bars 19 and 20 scrape paint from the outer surface 38 of the bristles 36.

To finish cleaning the bristles 36 of the paintbrush 33, the user slowly pulls the brush 33 outwardly in the direction indicated by directional arrow 67 until the bristles 36 are freed from the device 10. Then the user may open the handle 11 and repeat the process by closing the cleaning heads 15 and 16 again on the bristles 36 near the handle end 37 of the paintbrush 33 and pulling the paintbrush 33 through the device 10. Repeatedly drawing the bristles 36 through the cleaning heads 15 and 16 under running water (not shown) or a solvent (not shown) will thoroughly clean the brush 33.

The cleaning process as described herein may be performed without water or a solvent to scrape paint from the paintbrush 33 for reuse. Further, in one embodiment the device includes a paint catching reservoir (not shown) affixed to the handle 11 to receive paint pulled from the brush 33, as further discussed below and with respect to FIG. 10.

The illustrated embodiment includes squeegee bars 19 and 20 (FIG. 1) disposed on the cleaning heads 15 and 16. In other embodiments, the cleaning heads 15 and 16 may not include squeegee bars 19 and 20, and in such embodiments, the cleaning is done by the plurality of teeth 21 and 22.

Figure 7:
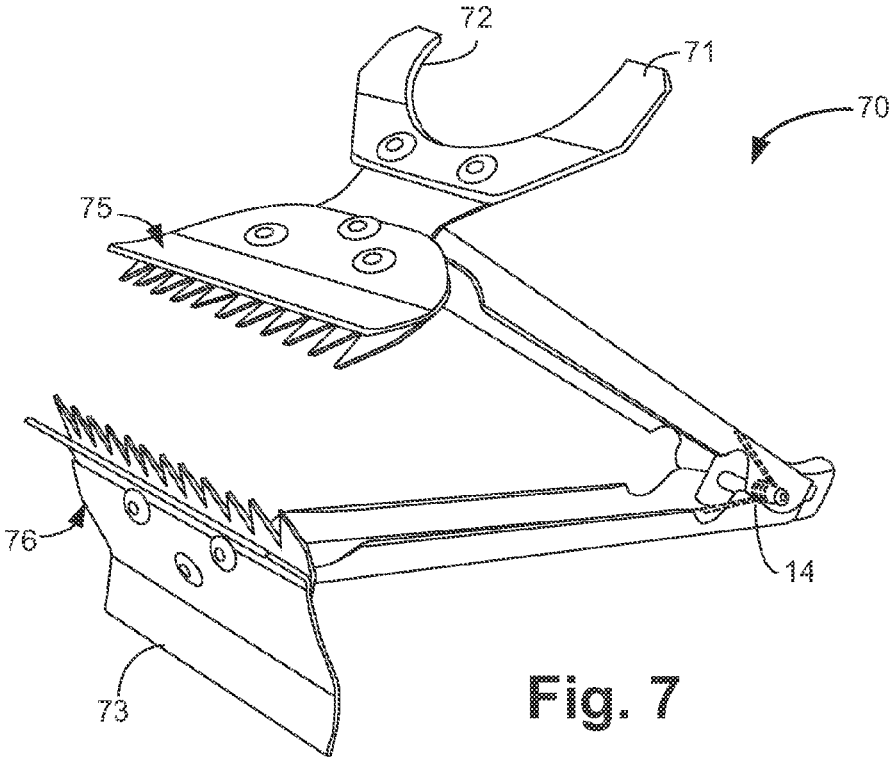
FIG. 7 is a front perspective view of an alternative embodiment of an exemplary device in accordance with the present disclosure.

FIG. 7 is a front perspective view of an alternative embodiment of a paintbrush cleaning device 70 according to the present disclosure. In this embodiment, the device 10 comprises cleaning heads 75 and 76 that are similar to the cleaning heads 15 and 16 of the device of FIG. 1. However, in this embodiment, a paint roller scraper 71 is disposed on the cleaning head 75, and a paint scraper 73 is disposed on the cleaning head 76. The paint roller scraper 71 comprises a semi-circular extension 72 that the user (not shown) can utilize to scrape paint from a traditional paint roller (not shown) by drawing the paint roller through the semi-circular extension 72. The paint scraper 73 is an angled extension from the cleaning head 76 that may be used to scrape paint (not shown) from flat surfaces (not shown).

Figure 8:
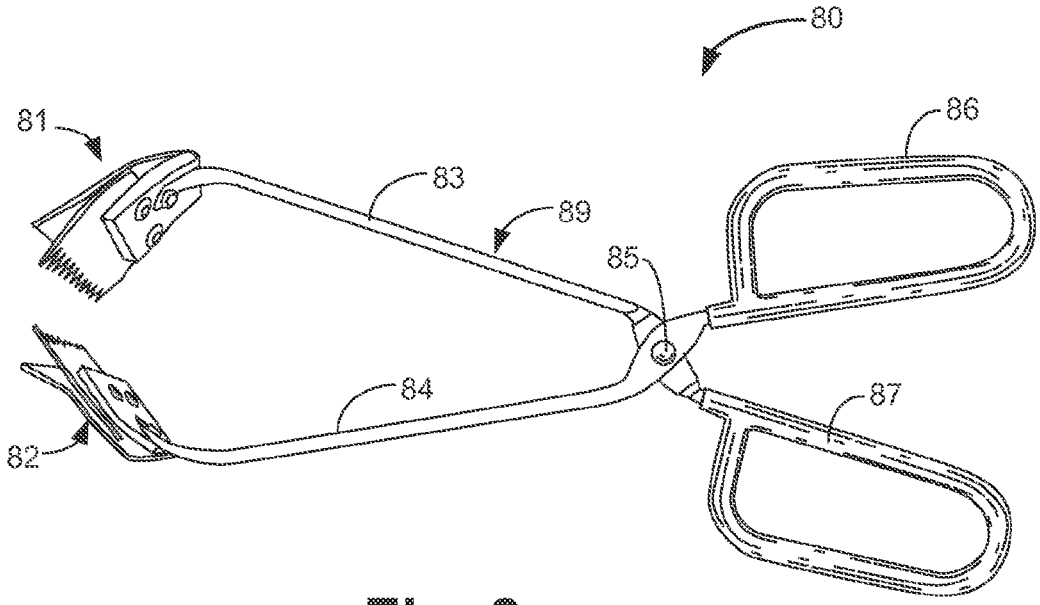
FIG. 8 is a side view of an alternative embodiment of an exemplary device in accordance with the present disclosure.

FIG. 8 is a side view of a device 80 with an alternative handle 89. In this embodiment, the handle 89 comprises an arm 83 rotatably connected to an arm 84 via a fastener 85. The arms 83 and 84 comprise cleaning heads 81 and 82, respectfully, that are substantially similar to the cleaning heads 15 and 16 (FIG. 1).

The arm 83 is rigidly affixed to a handle grip 87 and the arm 84 is rigidly affixed to a handle grip 86. The fastener is disposed between the arm 83 and its handle grip 87 and between the arm 84 and its handle grip 86, in a scissor-like fashion. No spring 14 (FIG. 1) is required in this embodiment.

In operation of the device 80, the user grasps the handle grips 86 and 87 and separates them to separate the cleaning head 81 from the cleaning head 82. The user then closes the cleaning heads 81 and 82 on the paintbrush (not shown) by compressing the handle grips 86 and 87 together. The user then pulls the brush slowly from the cleaning heads 81 and 82 in the manner discussed above with respect to FIG. 6.

Figure 9:
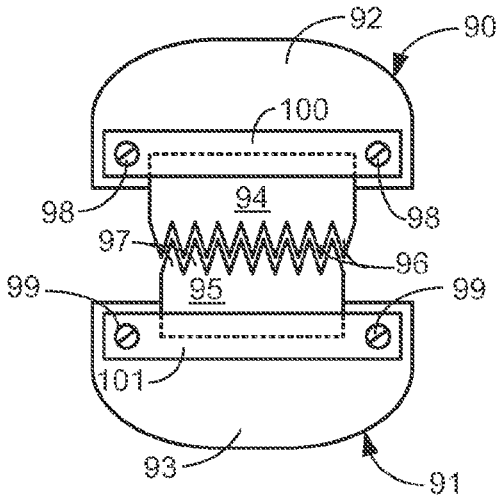
FIG. 9 is a front view of an alternative embodiment of interlocking cleaning heads according to the present disclosure.

FIG. 9 is a front plan view of an alternative embodiment of the disclosure showing cleaning heads 90 and 91. Tooth bars 94 and 95 each comprise a plurality of interlockable teeth 96 and 97, respectively. The tooth bars 94 and 95 are removably affixed to the cleaning heads 90 and 91. In this regard, the tooth bars 94 and 95 are sandwiched between backing plates 92 and 93, respectively, and retaining bars 100 and 101, respectively. The retaining bars 100 and 101 are secured to the backing plates 92 and 93, respectively, by fasteners 90 and 99, respectively. The tooth bars 94 and 95 are removable and replaceable by removing the fasteners 98 and 99 which connect the tooth bars 94 and 95 to the backing plates 92 and 93, respectively. Note that there are no squeegee bars 19 and 20 (FIG. 1) in this embodiment.

Figure 10:
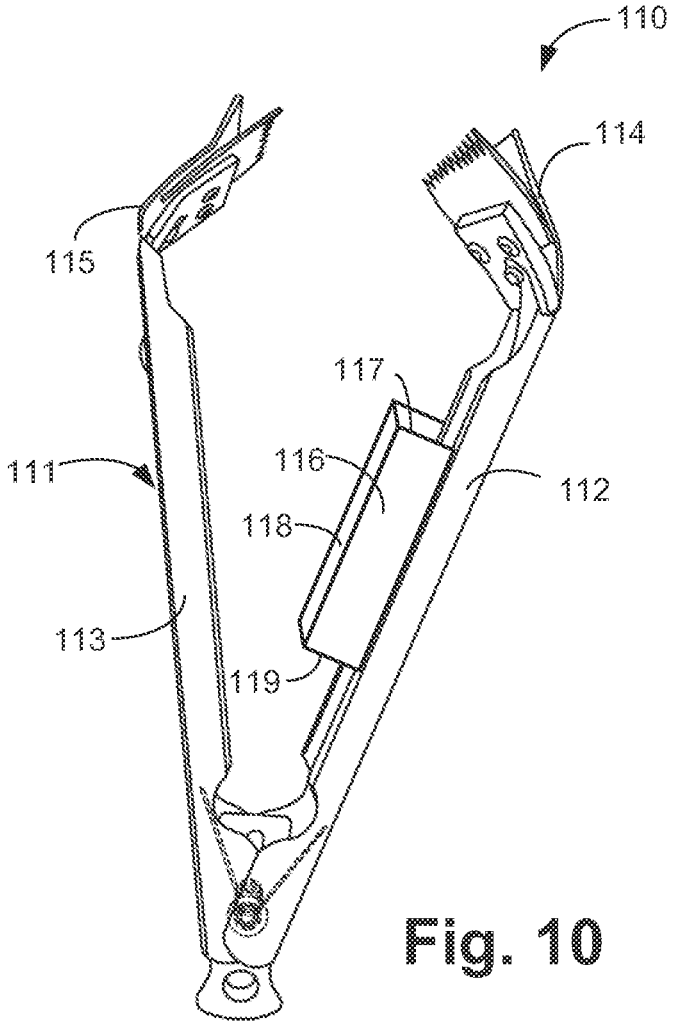
FIG. 10 is a side view of an alternative embodiment of the device according to the present disclosure.

FIG. 10 is a side view of an alternative embodiment of a device 110 according to the present disclosure. The device comprises a handle 111 comprised of arms 112 and 113. Cleaning heads 114 and 115 disposed on the arms 112 and 113, respectively, are substantially similar to the cleaning heads 15 and 16 discussed above with respect to FIG. 1. In this embodiment, the device 110 further comprises a paint collection reservoir 116 for collecting paint (not shown) removed from paintbrushes (not shown). The paint collection reservoir 116 comprises an open reservoir that may collect and retain paint as paint is removed from the paintbrush, so that the paint may be reused.

The reservoir 116 is affixed to the arm 112 in the illustrated embodiment. The reservoir 116 comprises a fluid-retaining cavity 117 bounded by sidewalls 118 and a bottom wall 119. Although the sidewalls 118 illustrated in FIG. 10 are shown as straight-sided, the sidewalls may be curved in other embodiments.

What is claimed is:

1. A device comprising:

a first cleaning head comprising a first tooth plate;

a second cleaning head comprising a second tooth plate, the first tooth plate comprising a first plurality of teeth and the second tooth plate comprising a second plurality of teeth;

whereby the first plurality of teeth are interlockable with the second plurality of teeth to form interlocked teeth when the first and second cleaning heads are drawn together;

a handle rotatably connecting the first cleaning head to the second cleaning head, wherein the handle comprises a first arm rigidly affixed to the first cleaning head and a second arm rigidly affixed to the second cleaning head, and wherein the first and second tooth plates are disposed generally perpendicular to longitudinal axes of the first and second arms, such that the interlocked teeth are positioned transverse to the longitudinal axes, and wherein the interlocked teeth extend beyond opposed side edges of the first and second arms.

2. The device of claim 1, wherein the first arm is disposed at an acute angle to the second arm.

3. The device of claim 1 wherein the first tooth plate extends inwardly at an obtuse angle from the first arm and the second tooth plate extends inwardly at an obtuse angle to the second arm.

4. The device of claim 1, further comprising a spring that urges the first arm away from the second arm unless acted upon by an outside force.

5. The device of claim 1, further comprising a handle lock that, when activated, maintains the handle in a closed position.

6. The device of claim 1 wherein the teeth in the first and second plurality of teeth are V-shaped.

7. The device of claim 1 wherein the teeth of the first plurality of teeth are formed from and integral with the first tooth plate and the teeth of the second plurality of teeth are formed from and integral with the second tooth plate.

8. The device of claim 1 in which the first arm and the second arm are hingedly coupled together and biased with a spring.

9. A device comprising:

a first cleaning head comprising a first plurality of teeth;

a second cleaning head comprising a second plurality of teeth;

whereby the first plurality of teeth are interlockable with the second plurality of teeth; a handle rotatably connecting the first cleaning head to the second cleaning head, wherein the handle comprises a first arm rigidly affixed to the first cleaning head and a second arm rigidly affixed to the second cleaning head, wherein the first cleaning head further comprises a first squeegee bar and the second cleaning head further comprises a second squeegee bar.

10. The device of claim 9, wherein the first squeegee bar is disposed at a first angle to the first plurality of teeth to form a first gap between tips of the first plurality of teeth and an outermost edge of the first squeegee bar.

11. The device of claim 10, wherein the second squeegee bar is disposed at a second angle to the second plurality of teeth to form a second gap between tips of the second plurality of teeth and an outermost edge of the second squeegee bar.

12. A device comprising:

a handle comprising a first arm and a second arm rotatably coupled together;

the first arm comprising a first cleaning head;

the second arm comprising a second cleaning head; and wherein the first cleaning head comprises a first tooth plate, the first tooth plate comprising a first plurality of teeth and the second cleaning head comprises a second tooth plate, the second tooth plate comprising a second plurality of teeth, and wherein the first tooth plate extends toward the second tooth plate, and wherein the first plurality of teeth is interlockable with the second plurality of teeth to form interlocked teeth when the first and second cleaning heads are drawn together, and wherein the first and second tooth plates and the interlocked teeth are disposed generally perpendicular to longitudinal axes of the first and second arms, and wherein the first and second tooth plates and the first and second plurality of teeth extend beyond opposed side edges of the first and second arms, respectively.

13. The device of claim 12, wherein the first arm is disposed at an acute angle to the second arm.

14. The device of claim 13, wherein the first tooth plate extends inwardly at an obtuse angle to the first arm and the second tooth plate extends inwardly at an obtuse angle to the second arm.

15. The device of claim 12, wherein the first cleaning head further comprises a first squeegee bar and the second cleaning head further comprises a second squeegee bar.

16. The device of claim 15, wherein the first squeegee bar is disposed at a first angle to the first plurality of teeth to form a first gap between tips of the first plurality of teeth and an outermost edge of the first squeegee bar.

17. The device of claim 12, further comprising a paint collection reservoir affixed to the handle.

* * * * *